US008014705B2

(12) United States Patent
Matsumoto et al.

(10) Patent No.: US 8,014,705 B2
(45) Date of Patent: Sep. 6, 2011

(54) DEVELOPING DEVICE, IMAGE SUPPORTER UNIT, AND IMAGE FORMATION APPARATUS

(75) Inventors: Takuji Matsumoto, Saitama (JP); Kiyoshi Sakoh, Saitama (JP); Toyohiko Awano, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 711 days.

(21) Appl. No.: 12/108,555

(22) Filed: Apr. 24, 2008

(65) Prior Publication Data

US 2008/0267672 A1 Oct. 30, 2008

(30) Foreign Application Priority Data

Apr. 26, 2007 (JP) ..... 2007-116454

(51) Int. Cl.
*G03G 15/09* (2006.01)

(52) U.S. Cl. ..... 399/274; 399/277

(58) Field of Classification Search ..... 399/274, 399/275, 277

See application file for complete search history.

(56) References Cited

U.S. PATENT DOCUMENTS

| | | | | |
|---|---|---|---|---|
| 5,158,852 | A | 10/1992 | Sakata et al. | |
| 5,781,836 | A * | 7/1998 | Tada et al. | 399/275 |
| 7,577,388 | B2 * | 8/2009 | Matsumoto | 399/277 |

FOREIGN PATENT DOCUMENTS

| | | | |
|---|---|---|---|
| JP | 55-050274 | A | 4/1980 |
| JP | 58-65465 | A | 4/1983 |
| JP | 59-189379 | A | 10/1984 |
| JP | 2-239268 | A | 9/1990 |
| JP | 3-163569 | A | 7/1991 |
| JP | 7-261557 | A | 10/1995 |
| JP | 08-006398 | A | 1/1996 |
| JP | 8-114983 | A | 5/1996 |
| JP | 8-234567 | A | 9/1996 |
| JP | 11-007194 | A | 1/1999 |
| JP | 2003-140463 | A | 5/2003 |
| JP | 2004-139123 | A | 5/2004 |

OTHER PUBLICATIONS

Notification of Reason for Refusal issued in counterpart Japanese Application No. 2007-116454 dated Mar. 23, 2010.

Notification of Reason for Refusal dated Jun. 15, 2010, issued in counterpart Japanese Application No. 2007-116454.

* cited by examiner

*Primary Examiner* — William J Royer
(74) *Attorney, Agent, or Firm* — Sughrue Mion, PLLC

(57) ABSTRACT

A developing device includes: a developer supporter that includes: a magnet member that has a plurality of magnetic poles; and a cylinder member; and a thickness regulation member wherein, of the plurality of the magnetic poles, a magnetic pole, which is placed at a position nearest to the thickness regulation member downstream in a rotation direction of the cylinder member from the thickness regulation member, has a maximum position of a normal magnetic flux density distribution, and the maximum position is placed outside the area of angle α downstream in the rotation direction of the cylinder member from the thickness regulation member, and wherein the diameter of the cylinder member is D, the projection width is W in a case where the thickness regulation member is projected onto the surface of the cylinder member, and the angle α is 180×W/(D×π).

7 Claims, 16 Drawing Sheets

FIG. 8A

| TEST NO. | ANGLE AND THICKNESS REGULATION POLE PEAK SETUP POSITION | | | | DENSITY UNEVENNESS OCCURRENCE SITUATION*2 | | |
|---|---|---|---|---|---|---|---|
| | SLEEVE OUTER DIAMETER D (mm) | THICKNESS REGULATION MEMBER OUTER DIAMETER (mm) | ANGLE (°) | THICKNESS REGULATION POLE PEAK POSITION*1 (°) | TONER DENSITY (4%) | TONER DENSITY (8%) | TONER DENSITY (12%) |
| A | 12 | 5 | 24.6 | -5 | ○ | ○ | ○ |
| B | | | | 0 | ○ | ○ | △ |
| C | | | | 5 | ○ | △ | × |
| D | | | | 10 | ○ | △ | × |
| E | | | | 15 | ○ | × | × |
| F | | | | 22 | ○ | × | × |
| G | | | | 27 | ○ | ○ | ○ |
| H | | | | 30 | ○ | ○ | ○ |
| I | 16 | 5 | 18.2 | -5 | ○ | ○ | ○ |
| J | | | | 0 | ○ | ○ | △ |
| K | | | | 5 | ○ | △ | △ |
| L | | | | 10 | ○ | × | × |
| M | | | | 15 | ○ | × | × |
| N | | | | 22 | ○ | ○ | ○ |
| O | | | | 27 | ○ | ○ | ○ |
| P | | | | 30 | ○ | ○ | ○ |

DENSITY UNEVENNESS OCCURRENCE SITUATION

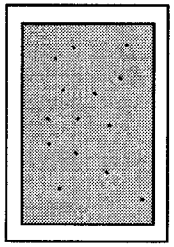

EVALUATION CRITERION
○: NO OCCURRENCE (NO PRACTICAL PROBLEM)
△: OCCURRENCE OF SLIGHT DENSITY UNEVENNESS (WITH PRACTICAL ANXIETY)
×: OCCURRENCE (INVOLVING PRACTICAL PROBLEM)

*1: PEAK-TO-PEAK ANGLE OF NORMAL MAGNETIC FLUX DENSITY DISTRIBUTION OF THICKNESS REGULATION POLE FROM CENTER POSITION OF THICKNESS REGULATION MEMBER (DOWNSTREAM SIDE IN DEVELOPER TRANSPORT DIRECTION IS +)

*2: DENSITY UNEVENNESS OCCURRENCE SITUATION AT PRINTING TIME OF HALF-TONE IMAGE IS CLASSIFIED INTO THREE LEVELS FOR EACH OF THREE TONER DENSITIES

WHEN SLEEVE OUTER DIAMETER IS 12 mm

WHEN SLEEVE OUTER DIAMETER IS 16 mm

FIG. 11A

| TEST NO. | ANGLE (°) | THICKNESS REGULATION POLE PEAK POSITION*1 (°) | ADJACENT POLE PEAK POSITION*3 (°) | DENSITY UNEVENNESS OCCURRENCE SITUATION*2 TONER DENSITY (4%) | TONER DENSITY (8%) | TONER DENSITY (12%) |
|---|---|---|---|---|---|---|
| A | 24.6 | -15 | 34.7 | △ | × | × |
| B | | -15 | 41.3 | × | × | × |
| C | | -15 | 47.0 | ○ | △ | × |
| D | | -8 | 41.7 | × | × | × |
| E | | -8 | 48.3 | ○ | △ | △ |
| F | | -8 | 54.0 | ○ | ○ | ○ |
| G | | -3 | 44.7 | × | × | × |
| H | | -3 | 53.3 | ○ | ○ | ○ |
| I | | -3 | 59.0 | ○ | ○ | ○ |

EVALUATION CRITERION
○: NO OCCURRENCE (NO PRACTICAL PROBLEM)
△: OCCURRENCE OF SLIGHT DENSITY UNEVENNESS (WITH PRACTICAL ANXIETY)
×: OCCURRENCE (INVOLVING PRACTICAL PROBLEM)

*1: PEAK-TO-PEAK ANGLE OF NORMAL MAGNETIC FLUX DENSITY DISTRIBUTION OF THICKNESS REGULATION POLE FROM CENTER POSITION OF THICKNESS REGULATION MEMBER (DOWNSTREAM SIDE IN DEVELOPER TRANSPORT DIRECTION IS +)

*2: DENSITY UNEVENNESS OCCURRENCE SITUATION AT PRINTING TIME OF HALF-TONE IMAGE IS CLASSIFIED INTO THREE LEVELS FOR EACH OF THREE TONER DENSITIES

2=49.2

FIG. 11B

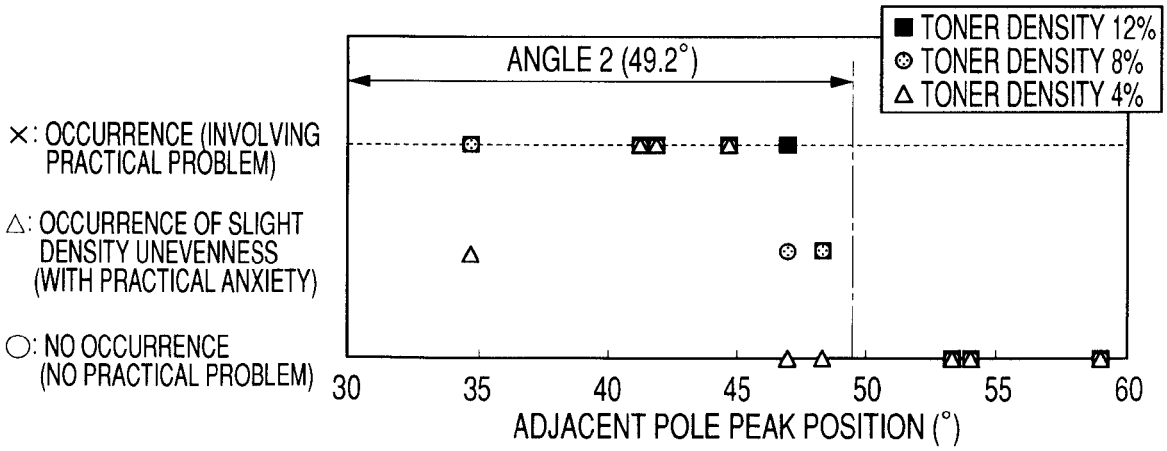

DEVELOPING DEVICE, IMAGE SUPPORTER UNIT, AND IMAGE FORMATION APPARATUS

CROSS-REFERENCE TO RELATED APPLICATIONS

This application is based on and claims priority under 35 U.S.C. 119 from Japanese Patent Application No. 2007-116454 filed Apr. 26, 2007.

BACKGROUND

1. Technical Field

This invention relates to a developing device, an image supporter unit, and an image formation apparatus.

2. Related Art

Hitherto, an image formation apparatus such as an electrophotographic copier or printer develops a latent image formed on the surface of a photoconductor by a developing device and transfers and fixes the developed visible image onto a medium, thereby forming an image. The developing device has a developer supporter, for example, a developing roller opposed to the photoconductor, and a developer of a predetermined thickness is deposited on the surface of the developing roller and is transported and supplied to a developing area of an opposed area to the photoconductor.

SUMMARY

According to an aspect of the present invention, a developing device includes: a developer supporter that includes: a magnet member that has a plurality of magnetic poles; and a cylinder member that is placed on the outer periphery of the magnet member, and that rotates pre se, the developer supporter supporting a developer on a surface of the cylinder member; and a thickness regulation member that has a cylindrical shape, that is made of a magnetic material, that is placed facing the surface of the cylinder member with a predetermined spacing, and that regulates the thickness of the developer deposited on the surface of the cylinder member, wherein, of the plurality of the magnetic poles, a magnetic pole, which is placed at a position nearest to the thickness regulation member downstream in a rotation direction of the cylinder member from the thickness regulation member, has a maximum position of a normal magnetic flux density distribution, and the maximum position of the normal magnetic flux density distribution is placed outside the area of angle $\alpha$ downstream in the rotation direction of the cylinder member from the thickness regulation member, and wherein the diameter of the cylinder member is D, a projection width is W in a case where the thickness regulation member is projected onto the surface of the cylinder member, and the angle $\alpha$ is $180\times W/(D\times Tc)$.

BRIEF DESCRIPTION OF THE DRAWINGS

Exemplary embodiments of the present invention will be described in detail based on the following figures, wherein:

FIG. 6A is a schematic representation of the positional relationship in the first embodiment of the invention and FIG. 6B is a schematic representation of the positional relationship in a related art;

FIG. 7A is a function schematic representation of the relationship between magnetic poles and the thickness regulation member and a developer in the first embodiment of the invention; FIG. 7B is a function schematic representation of the relationship between magnetic poles and a thickness regulation member and a developer in a related art in a state in which the downstream developer amount is small; FIG. 7C is a function schematic representation of the relationship between the magnetic poles and the thickness regulation member and a developer in the related art in a state in which the developer is much deposited downstream from the thickness regulation member; and FIG. 7D is a function schematic representation of the relationship between the magnetic poles and the thickness regulation member and a developer in the related art in a state in which the developer deposited downstream from the thickness regulation member crumbles and is transported downstream;

FIGS. 8A to 8C are schematic representations of a first experimental example of the first embodiment of the invention; FIG. 8A is a list of the experiment results; FIG. 8B is a graph of the experiment results with the peak positions of a thickness regulation pole taken on a horizontal axis and the results of density unevenness occurrence situation taken on a vertical axis about an experiment with sleeve outer diameter 12 mm; and FIG. 8C is a graph of the experiment results with the peak positions of a thickness regulation pole taken on a horizontal axis and the results of density unevenness occurrence situation taken on a vertical axis about an experiment with sleeve outer diameter 16 mm;

FIG. 9A is a schematic representation of the positional relationship in the second embodiment of the invention corresponding to FIG. 6A in the first embodiment and FIG. 9B is a schematic representation of the positional relationship in a related art corresponding to FIG. 6B in the first embodiment;

FIG. 10A is a function schematic representation of the relationship between the magnetic poles and the thickness regulation member and a developer in the second embodiment of the invention and FIG. 10B is a function schematic representation of the relationship between the magnetic poles and the thickness regulation member and a developer in the related art in a state in which the developer is much deposited downstream from the thickness regulation member;

FIGS. 11A to 11B are schematic representations of a second experimental example of the second embodiment of the invention;

FIG. 11A is a list of the experiment results and FIG. 11B is a graph of the experiment results with the peak positions of an adjacent pole taken on a horizontal axis and the results of density unevenness occurrence situation taken on a vertical axis about the experiment results in FIG. 11A;

FIG. 14A is a schematic representation of an end part of the thickness regulation member and FIG. 14B is a drawing of the end part seen from arrow XIVB direction in FIG. 14A.

DETAILED DESCRIPTION

Figure 1:
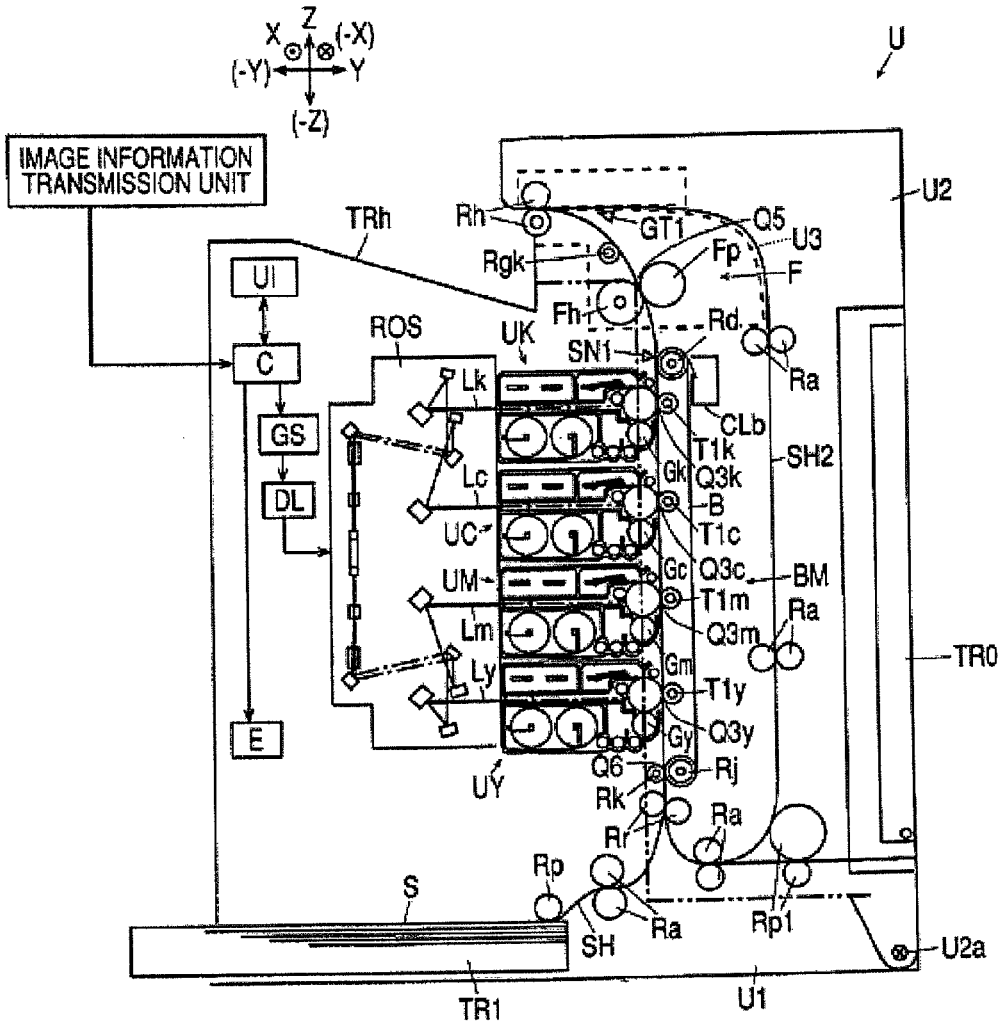
FIG. 1 is a general schematic representation of an image formation apparatus of a first embodiment of the invention.

Referring now to the accompanying drawings, there are shown preferred embodiments of the invention, but the invention is not limited to the specific embodiments described below.

For easy understanding of the description to follow, in the accompanying drawings, back and forth direction is X axis direction, side to side direction is Y axis direction, and up and down direction is Z axis direction, and directions or sides indicated by arrows X, −X, Y, −Y, Z, and −Z are forward, backward, rightward, leftward, upward, and downward or front, rear (back), right, left, upper side (top), and lower side (bottom).

In the accompanying drawings, a mark including a dot described in a circle means an arrow from the back of the plane of the drawing to the surface and a mark including an X described in a circle means an arrow from the surface of the plane of the drawing to the back.

In the description that follows using the accompanying drawings, members other than the members required for the description are not shown in the drawings where appropriate for easy understanding of the description.

First Embodiment

FIG. 1 is a general schematic representation of an image formation apparatus of a first embodiment of the invention.

Figure 2:
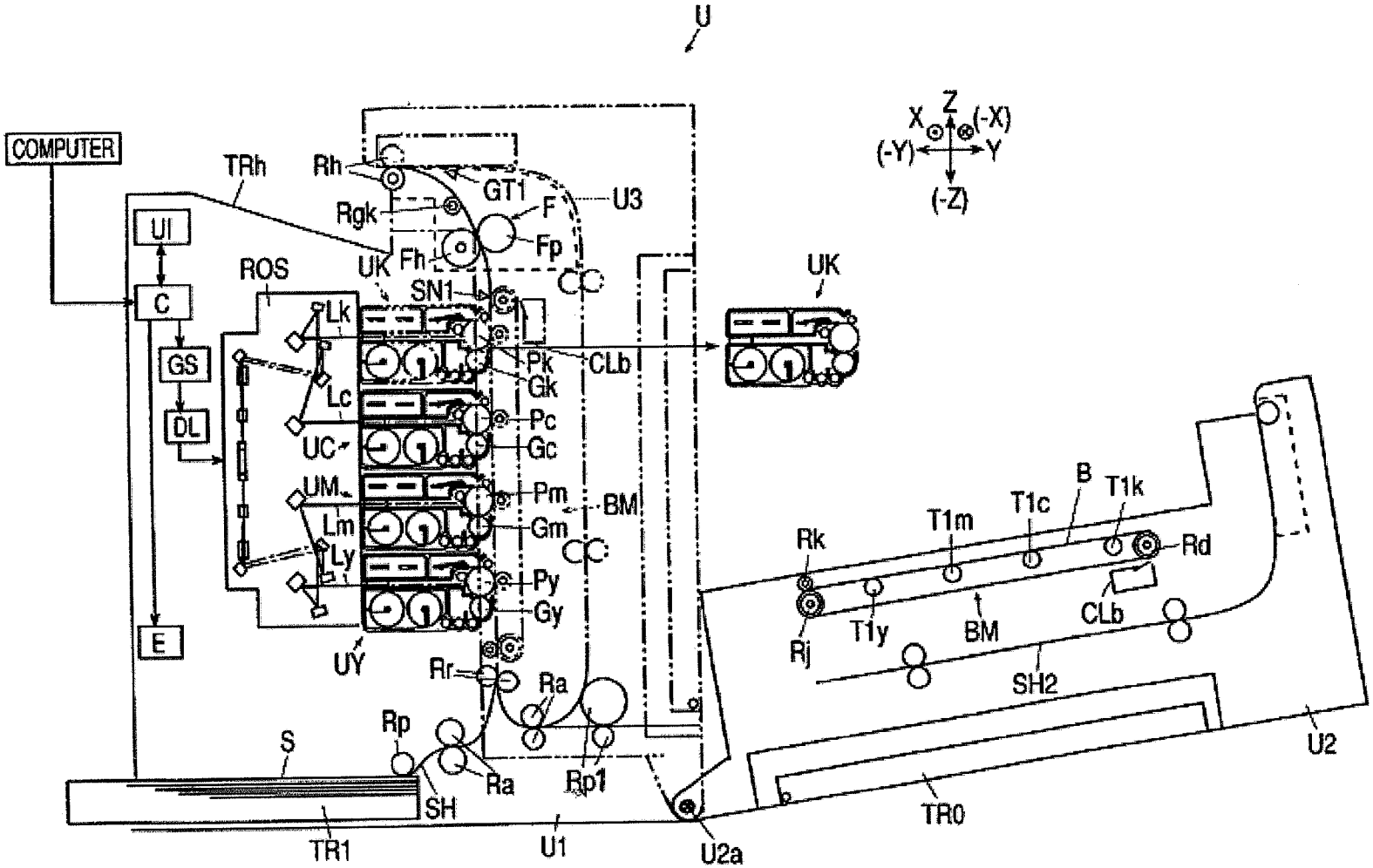
FIG. 2 is a schematic representation of a state in which an opening-closing section of the image formation apparatus of the first embodiment of the invention is opened.

FIG. 2 is a schematic representation of a state in which an opening-closing section of the image formation apparatus of the first embodiment of the invention is opened.

In FIG. 1, in a printer U as an example of the image formation apparatus of the first embodiment of the invention, a paper feed vessel TR1 storing a record medium S as an example of a medium to record an image thereon is housed at the bottom of the printer U and a paper ejection section TRh is provided on the top of the printer U. An operation section UI is provided in an upper portion of the printer U.

In FIGS. 1 and 2, the printer U of the first embodiment has an image formation apparatus main body U1 and an opening-closing section U2 that can be opened and closed with a rotation center U2*a* provided in the right lower end part of the image formation apparatus main body U1 as the center. The opening-closing section U2 can be moved between an open position (see the solid line in FIG. 2) for opening the inside of the image formation apparatus main body U1 to replenish with a developer, replace a faulty member, or remove a record medium S as a paper jam and a closed position (see the alternate long and two short dashes lines in FIGS. 1 and 2) retained at the usual time during which the image formation operation is executed.

The printer U has a control section C for performing various types of control of the printer U, an image processing section GS controlled by the control section C, an image writer drive circuit DL, a power supply unit E, and the like. The power supply unit E applies a voltage to charging rollers CRy, CRm, CRc, and CRk as an example of chargers described later, developing rollers G1*y*, G1*m*, G1*c*, and G1*k* as an example of developer supporters described later, transfer rollers T1*y*, T1*m*, T1*c*, and T1*k* as an example of transfer devices described later, and the like.

The image processing section GS converts print information input from an external image information transmission unit, and the like, into image information for latent image formation corresponding to images of four colors of K (black), Y (yellow), M (magenta), and C (cyan) and outputs the image information to the image writer drive circuit DL at a predetermined timing. The image writer drive circuit DL outputs a drive signal to a latent image writer ROS in response to the input color image information. The latent image writer ROS emits a laser beam Ly, Lm, Lc, Lk as an example of image write light for color image write in response to the drive signal.

In FIG. 1, placed on the right of the latent image writer ROS (+Y direction) is visible image formation units UY, UM, UC, and UK as an example of image supporter units for forming toner images as an example of visible images of colors of Y (yellow), M (magenta), C (cyan), and K (black).

Figure 3:
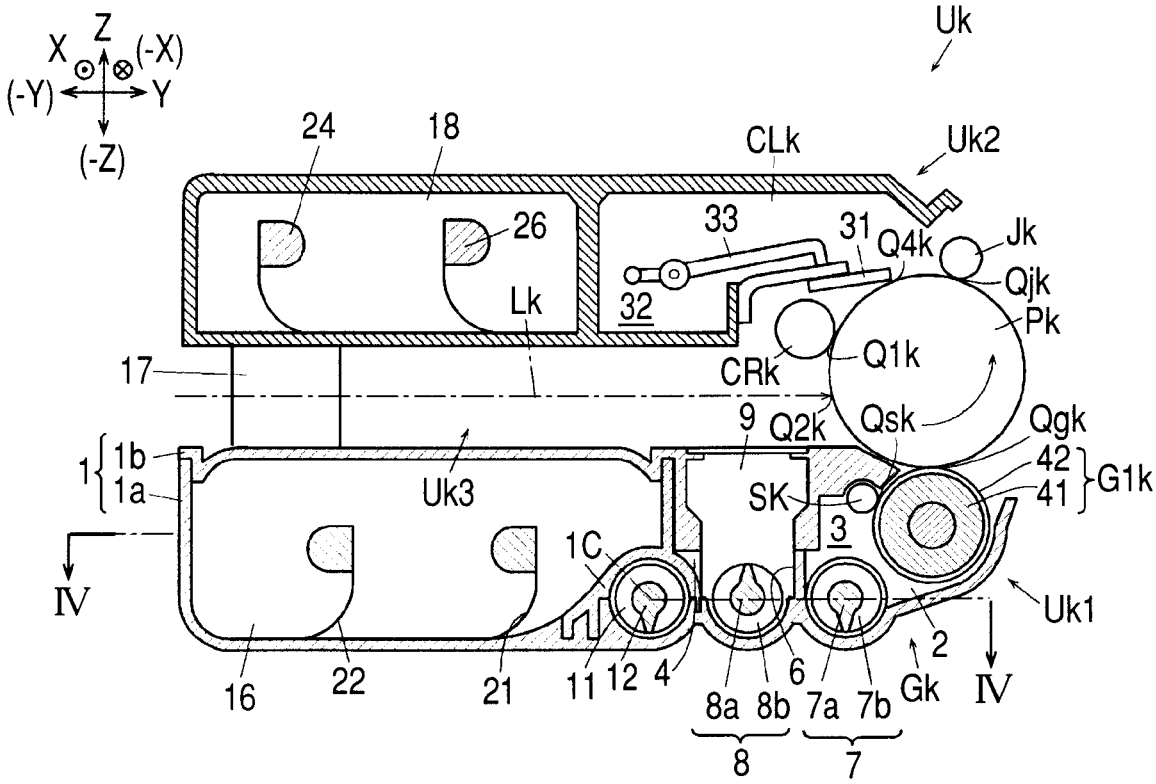
FIG. 3 is a schematic representation of a visible image formation unit as an example of a detachable body of the first embodiment of the invention.

FIG. 3 is a schematic representation of the visible image formation unit Uk for black (K) toner, which is an example of a detachable body of the first embodiment of the invention. The visible image formation units for the other colors, Y (yellow), M (magenta), and C (cyan), are not shown but have structures similar to that of Uk, and the features of those other units are indicated below with the reference numerals corresponding to the color, even though those reference numerals may not be shown in the figures. For example, the charging rollers CRy, CRm, and CRc for the yellow, magenta and cyan toners, respectively, correspond to the charging roller CRk for black toner shown in FIG. 3.

In FIG. 3, the visible image formation unit UK of black (K) has a photoconductor Pk as an example of a rotating image supporter. The photoconductor Pk is surrounded by the charging roller CRk as an example of a charger, a developing device Gk for developing an electrostatic latent image on the surface of the photoconductor Pk to a visible image, a static eliminating member Jk for removing electricity on the surface of the photoconductor Pk, a photoconductor cleaner CLk as an example of an image supporter cleaner for removing the developer remaining on the surface of the photoconductor Pk, and the like.

The photoconductor Pk has the surface uniformly charged by the charging roller CRk in a charging area Q1*k* opposed to the charging roller CRk and then a latent image is written to the photoconductor Pk with the laser beam Lk in a latent image formation area Q2*k*. The written latent image is rendered visible in a developing area Qgk opposed to the developing device Gk.

The black visible image formation unit UK of the first embodiment is implemented as a detachable body, a process cartridge UK made up of the photoconductor Pk, the charging roller CRk, the developing device Gk, the static eliminating member Jk, the photoconductor cleaner CLk, a developer replenishment vessel, for example, 11, 16, 18, and the like, in one piece, and can be attached to and detached from the image formation apparatus main body U1 in a state in which the opening-closing section U2 is moved to the open position as shown in FIG. 2.

The visible image formation units UY, UM, and UC of other colors are also implemented as detachable bodies that can be attached to and detached from the printer main body U1, process cartridges UY, UM, and UC like the black visible image formation unit UK.

In FIGS. 1 and 2, a belt module BM as an example of a record medium transport unit supported on the opening-closing section U2 is placed on the right of the photoconductors Py, Pm, Pc, and Pk. The belt module BM has a medium transport belt B as an example of a record medium retention and transport member, belt support rollers (Rd+Rj) as an example of a retention and transport member support system containing a belt drive roller Rd as an example of a drive member and a driven roller Rj as an example of a driven member for supporting the medium transport belt B, transfer rollers T1*y*, T1*m*, T1*c*, and T1*k* as an example of transfer devices placed facing the photoconductors Py, Pm, Pc, and Pk, an image density sensor SN1 as an example of an image density detection member, a belt cleaner CLb as an example of a retention and transport member cleaner, and a medium attraction roller Rk as an example of a record medium attraction member placed facing the driven roller Rj for attracting a record medium S onto the medium transport belt B. The medium transport belt B is supported by the belt support rollers (Rd+Rj) for rotation. The image density sensor SN1 detects the density of a density detection image, a patch image formed by image density adjustment means (not shown) of the control section C. The image density adjustment means adjusts the voltage applied to the chargers CRy, CRm, CRc, and CRk, the developing devices Gy, Gm, Gc, and Gk, and the transfer rollers T1*y*, T1*m*, T1*c*, and T1*k* and adjusts the strengths of the latent image write light beams Ly, Lm, Lc, and Lk based on the image density detected by the image density detection member, thereby performing process control of adjusting and correcting the image density.

The record medium S in the paper feed vessel TR1 placed below the medium transport belt B is taken out by a paper feed member Rp and is transported to a record medium transport passage SH.

The record medium S in the record medium transport passage SH is transported by a medium transport roller as an example of a record medium transport member and is sent to a registration roller Rr as an example of a paper feed timing adjustment member. The registration roller Rr transports the record medium S to a record medium attraction position Q6 of an opposed area of the driven roller Rj and the medium attraction roller Rk at a predetermined timing. The record medium S transported to the record medium attraction position Q6 is electrostatically attracted onto the medium transport belt B.

To feed paper from a manual paper feed section TR0, the record medium S fed by a manual paper feed member Rpt is transported to the registration roller Rr by a medium transport roller Ra and is transported to the medium transport belt B.

The record medium S attracted onto the medium transport belt B passes in sequence through transfer areas Q3*y*, Q3*m*, Q3*c*, and Q3*k* for coming in contact with the photoconductors Py, Pm, Pc, and Pk.

Transfer voltage of the opposite polarity to the charge polarity of toner is applied from the power supply circuit E controlled by the control section C at a predetermined timing to the transfer rollers T1*y*, T1*m*, T1*c*, and T1*k* placed on the back of the medium transport belt B in the transfer areas Q3*y*, Q3*m*, Q3*c*, and Q3*k*.

For a multicolor image, the toner images on the photoconductors Py, Pm, Pc, and Pk are transferred onto the record medium S on the medium transport belt B by the transfer rollers T1*y*, T1*m*, T1*c*, and T1*k* as they are superposed on each other. For a single-color image or a monochrome image, only a K (black) toner image is formed on the photoconductor Pk and is transferred onto the record medium S by the transfer device T1*k*.

After the toner image transfer, the photoconductors Py, Pm, Pc, and Pk are subjected to electricity removal by the static eliminating members Jy, Jm, Jc, and Jk in static eliminating areas Qjy, Qjm, Qjc, and Qjk and then the toner remaining on the surfaces of the photoconductors Py, Pm, Pc, and Pk is collected and cleaned by the photoconductor cleaners CLy, CLm, CLc, and CLk in cleaning areas Q4*y*, Qom, Q4*c*, and Q4*k* and again the photoconductors Py, Pm, Pc, and Pk are charged by the charging rollers CRy, CRm, CRc, and CRk.

The record medium S onto which the toner image is transferred is fixed in a fixing area Q5 formed as a heating roller Fh as an example of a heat fixing member of a fixing device F as an example of a fixer and a pressurization roller Fp as an example of a pressurization fixing member are pressed against each other. The record medium S with an image fixed thereon is guided by a guide roll Rgk as an example of a guide member and is ejected from a paper ejection roll Rh as an example of a paper ejection member to a paper ejection section TRh.

After the record medium S is isolated, the medium transport belt B is cleaned by the belt cleaner CLb.

To perform duplex printing, the paper ejection roll Rh is driven backward and the record medium S is transported to a medium reversal passage SH2 by a switch member GT1 and is again sent to the registration roll Rr in a state in which the surface and the back are reversed.

The fixing device F, a drive roller on the lower side of the paper ejection roll Rh, the switch member GT1, and a guide face on the lower side of the medium reversal passage SH2 in the first embodiment are formed by an integrated replaceable fixing device, a fixing unit U3. A driven member on the upper side of the paper ejection roll Rh is supported on the opening-closing section U2.

(Description of Visible Image Formation Units)

Figure 4:
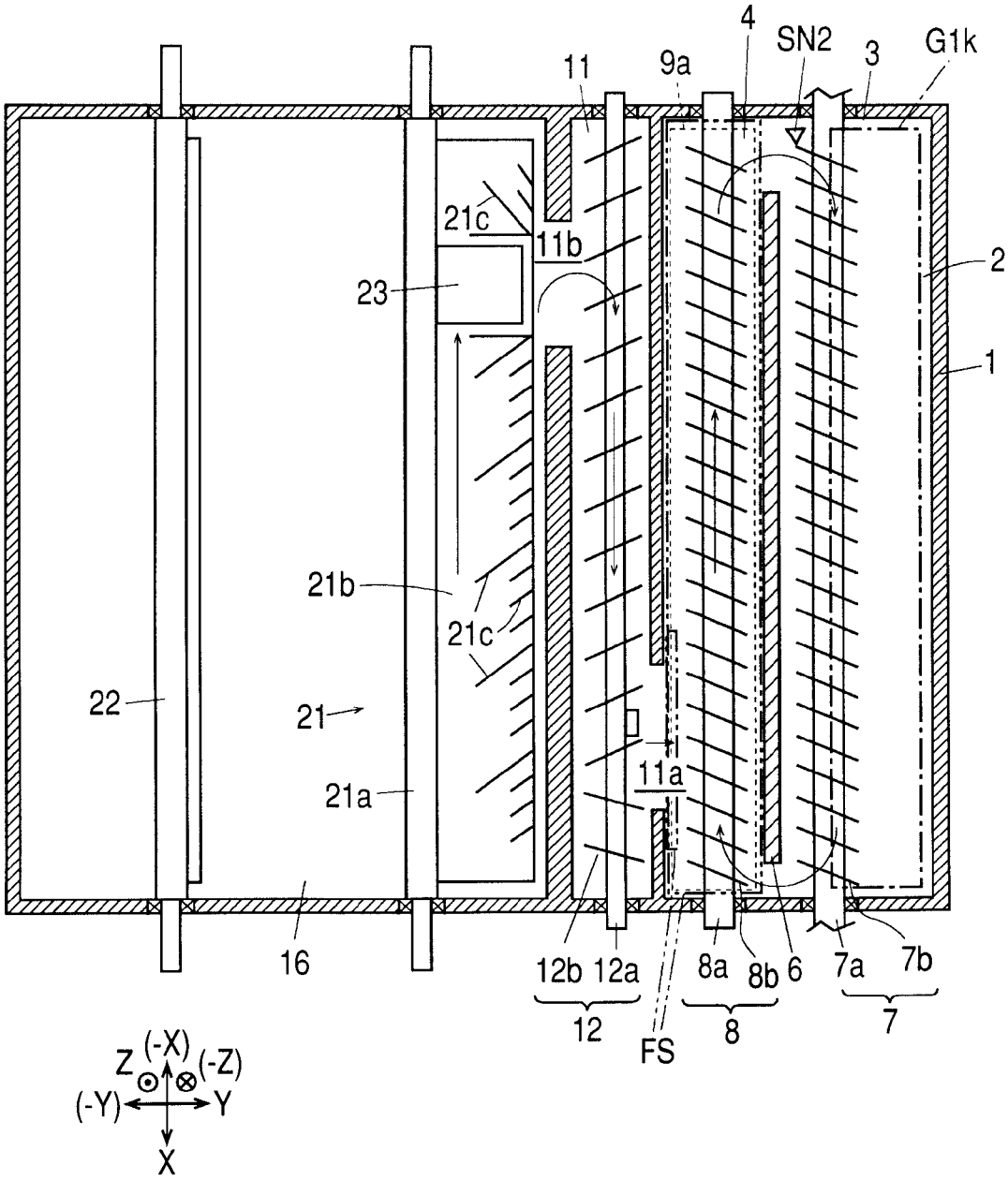
FIG. 4 is a sectional view taken on line IV-IV in FIG. 3.

FIG. 4 is a sectional view taken on line IV-IV in FIG. 3. The visible image formation units UY, UM, UC, and UK will be discussed in detail. Since the yellow, magenta, cyan, and black visible image formation units UY, UM, UC, and UK have similar configurations and therefore only the black visible image formation unit UK will be discussed and other visible image formation units UY, UM, and UC will not be discussed.

In FIGS. 3 and 4, the visible image formation unit UK is made up of a developing section Uk1 having the photoconductor Pk and the developing device Gk and a cleaning and charging section Uk2 having the charging roller CRk, the photoconductor cleaner CLk, and the static eliminating roller Jk as an assembly and a write light passage Uk3 through which the laser beam Lk passes is formed between the developing section Uk1 and the cleaning and charging section Uk2.

The developing section Uk1 has a developer storage vessel 1 for storing a developer. This developer storage vessel 1 has a developing vessel main body 1*a* on the lower side, a lid member 1*b* for closing the top face of the developing vessel main body 1*a*, and a center partition member 10 for partitioning the side-to-side center of the developing vessel main body 1*a* to form a developer transport chamber described later.

The developer storage vessel 1 has a developer supporter housing chamber 2 for supporting the developing roller G1*k* as an example of a developer supporter opposed to the photoconductor Pk, a first agitation transport chamber 3 adjacent to the left of the developer supporter housing chamber 2 for storing a developer, and a second agitation transport chamber 4 adjacent to the left of the first agitation transport chamber 3. Placed in the developer supporter housing chamber 2 is a thickness regulation member SK for regulating the thickness of the developer supported on the surface of the developing roller G1*k*.

The first agitation transport chamber 3 and the second agitation transport chamber 4 as an example of a developer storing chamber are partitioned by a partition wall 6 and allow the developer to move in both front and rear end parts.

As the developer, a dual-component developer containing toner and a carrier is stored in the developer storage vessel 1 of the first embodiment. The developer supporter housing chamber 2, the first agitation transport chamber 3, and the second agitation transport chamber 4 make up a developer storing chamber (2 to 4).

To detect the toner and carrier mixing percentage or the tone density, a toner density sensor SN2 as an example of a developer density detection member is placed in the rear end part of the first agitation transport chamber 3, namely, in the upstream end part in the developer transport direction in FIG. 4.

Agitation transport members 7 and 8 as an example of a developer transport member for transporting the developer in opposite directions while agitating the developer are placed in the first agitation transport chamber 3 and the second agitation transport chamber 4. The agitation transport member 7, 8 of the first embodiment is implemented as an agitation transport member or an auger having a rotation shaft 7*a*, 8*a* and a helical transport vane 7*b*, 8*b* fixed to and supported on the rotation shaft 7*a*, 8*a*.

The agitation transport member 7, 8 of the first embodiment is set as follows: The diameter of the rotation shaft 7*a*, 8*a* is 4 mm; the helical diameter of the diameter of the outer shape of the transport vane 7*b*, 8*b* is 8 mm; the pitch of the distance of an axial move while the transport vane 7*b*, 8*b* makes one helical revolution is 15 mm; and the number of revolutions is 408.39 rpm. These values can be changed as desired in response to the design.

In FIG. 3, an initial developer storing chamber 9 placed above the second agitation transport chamber 4 is formed in the lid member 1*b*. An opening 9*a* extending in a back and forth direction is formed in the lower end part of the initial developer storing chamber 9 as indicated by the dashed line in FIG. 4.

A cylindrical developer transport chamber or developer replenishment vessel 11 is formed on the left of the second agitation transport chamber 4. A developer replenishment port 11*a* connected to the second agitation transport chamber 4 is formed in the front end part of the developer transport chamber or developer replenishment vessel 11, and a developer inflow port 11*b* is formed in the rear end part. A developer replenishment member 12 for transporting the developer in the developer transport chamber or developer replenishment vessel 11 to the developer replenishment port 11*a* is placed in the developer transport chamber 11.

The developer replenishment member 12 of the first embodiment is set as follows: The diameter of a rotation shaft 12*a* is 4 mm; the helical diameter of the diameter of the outer shape of a transport vane 12*b* is 8 mm; the pitch of the distance of an axial move while the transport vane 12*b* makes one helical revolution is 8 mm; and the number of revolutions is 100 rpm. These values can be changed as desired in response to the design.

A first developer replenishment chamber 16 is formed on the left of the developer transport chamber or developer replenishment chamber 11, and a second developer replenishment chamber 18 connected through a developer drop passage 17 formed in the end part in the back and forth direction is placed above the first developer replenishment chamber 16. A first developer transport member (developer replenishment member) 21 and a second developer transport member (developer replenishment member) 22 for transporting the developer in the second developer replenishment chamber 16 to the developer inflow port 11*b* are placed in the first developer replenishment chamber 16.

The first developer transport member 21 has a rotation shaft part 21*a* and a transport thin film part 21*b* formed of a flexible resin thin film of PET (polyethylene terephthalate) supported on the rotation shaft part 21*a*. The transport thin film part 21*b* is formed with a notch 21*c* inclined with respect to the axial direction, and an auxiliary thin film 23 having enhanced strength, to allow the developer to easily flow into the developer inflow port 11*b*, is put on the position of the transport thin film part 21*b* opposed to the developer inflow port 11*b*. Therefore, when the first developer transport member 21 rotates, the developer is transported to the developer inflow port 11*b* at the rear with the transport thin film part 21*b* formed with the notch 21*c* and is transported to the developer transport chamber 11 in the portion of the auxiliary thin film 23.

The second developer transport member 22 transports the developer to the first developer transport member 21. A third developer transport member (developer replenishment member) 24 and a fourth developer transport member (developer replenishment member) 26 placed in the second developer replenishment chamber 18 transport the developer in the second developer replenishment chamber 18 to the developer drop passage 17.

The developer transport chamber 11, the first developer replenishment chamber 16, and the second developer replenishment chamber 18 make up the above-mentioned developer replenishment vessel, 11, 16 or 18, of the first embodiment.

The photoconductor cleaner CLk is placed on the right of the second developer replenishment chamber 18; it has a plate developer cleaning member, a cleaning blade 31 for coming in contact with the surface of the photoconductor Pk and a collected developer transport member 33 for transporting the developer scraped by the cleaning blade 31 to a collected developer storing chamber 32.

The visible image formation unit Uk is provided with a film sheet FS as an example of a partition-come-opening-closing member. The film sheet FS has an external end side derived to the outside through a through hole (not shown) of the visible image formation unit UK and an inner end side separated like a fork. One part of the fork shape is put on the lower face of the opening 9*a* in a state in which a developer dam member is at a storage position, namely, a rotation center is fitted into a dam member support hole and a dam member main body is in contact with the lower side of a storage position regulation member. The other part of the fork shape of the film sheet FS is put so as to close the developer replenishment port 11*a* of the developer transport chamber 11 as shown in FIG. 4.

Therefore, the opening 9*a* is closed by the film sheet FS and the initial developer storing chamber 9 is hermetically sealed and the developer transport chamber 11 and the developer storing chamber, including developer supporter housing chamber 2, first agitation transport chamber 3, and second agitation transport chamber 4, are also sealed.

In the first embodiment, a dual-component developer with toner and a carrier mixed in a predetermined percentage or an initial developer is stored in the hermetically sealed initial developer storing chamber 9, and toner is stored in the developer replenishment vessel, 11, 16 or 18, as a replenishment developer. The developer storing chamber, including developer supporter housing chamber 2, first agitation transport chamber 3, and second agitation transport chamber 4, is held in a state in which no developer exists. Therefore, the developer storing chamber, including developer supporter housing chamber 2, first agitation transport chamber 3, and second agitation transport chamber 4, does not contain any developer and is also sealed in a state in which the film sheet FS is put, so that the developer is prevented from leaking in storage in a warehouse or during transport. The film sheet FS is removed from the visible image formation unit Uk before the visible image formation unit Uk is placed in the printer main body U1, whereby the developer in the initial developer storing chamber 9 flows into the developer storing chamber, including developer supporter housing chamber 2, first agitation transport chamber 3, and second agitation transport chamber 4, and it is also made possible to replenish with a developer from the developer replenishment vessel, 11, 16, or 18.

The members 1 to 26 and FS, and the like, make up a developer transport unit.

(Description of Positional Relationship Between Developing Roller and Thickness Regulation Member)

Figure 5:
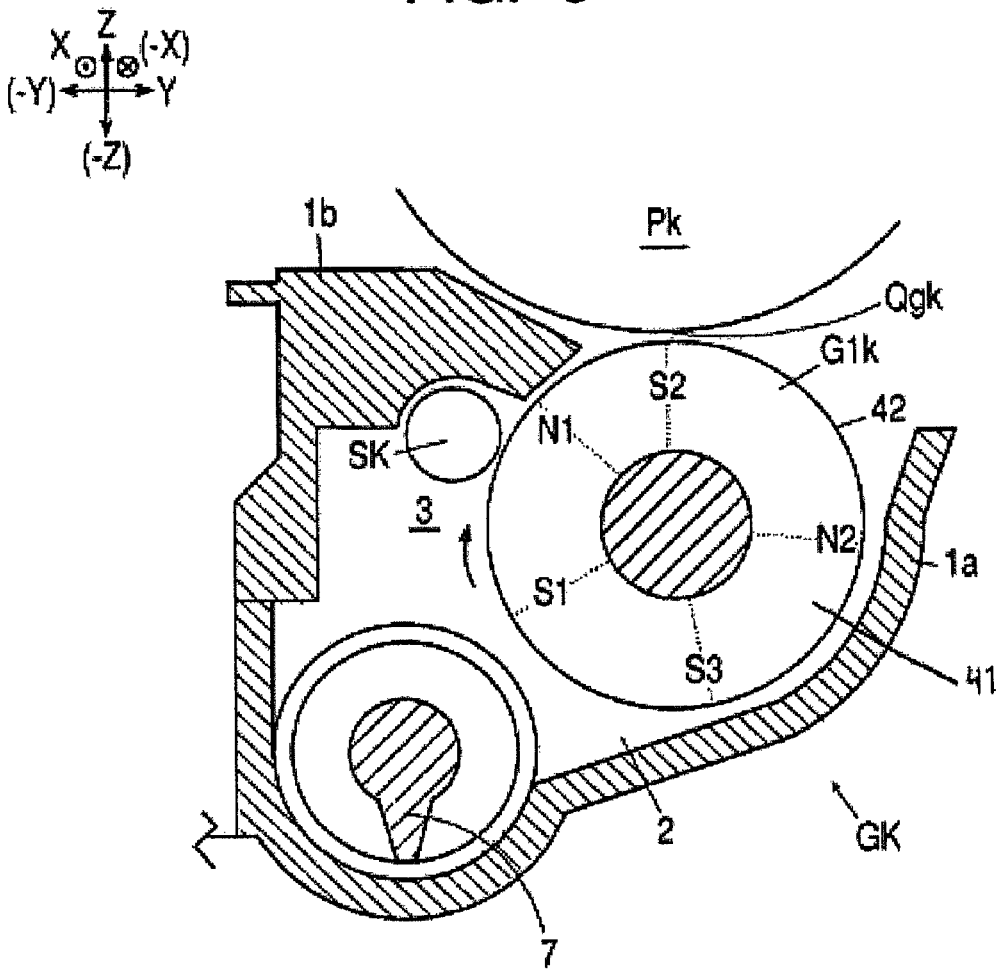
FIG. 5 is a main part enlarged schematic representation of the portion of an image supporter and a thickness regulation member of the first embodiment of the invention.

FIG. 5 is a main part enlarged schematic representation of the portion of the image supporter and the thickness regulation member of the first embodiment of the invention.

In FIG. 3, the developing roller G1*k* has an unrotatably supported magnet member 41 and a developing sleeve 42 as an example of a rotated cylinder member placed on the outer periphery of the magnet member 41. In FIGS. 3 and 5, the magnet member 41 of the first embodiment has five magnetic poles of a drawing magnetic pole S1 for depositing the developer in the developer storing chamber, including developer supporter housing chamber 2, first agitation transport chamber 3, and second agitation transport chamber 4, on the surface of the developing sleeve 42, a thickness regulation pole N1 placed downstream in the rotation direction of the developing sleeve 42 from the drawing magnetic pole S1, a developing pole S2 placed downstream in the rotation direction of the developing sleeve 42 from the thickness regulation pole N1 and in the proximity of a developing area Qgk, a transport pole N2 placed downstream in the rotation direction of the developing sleeve 42 from the developing pole S2, and a developer detachment pole S3 placed downstream in the rotation direction of the developing sleeve 42 from the transport pole N2.

Therefore, the developer in the developer storing chamber (2 to 4) is deposited on the surface of the developing sleeve 42 with the drawing magnetic pole S1 or pickup magnetic pole and is transported with rotation of the developing sleeve 42 and the thickness of the developer is regulated by the thickness regulation member SK and then the developer is used for developing in the developing area Qgk. The developer deposited on the surface of the developing sleeve 42 after passage through the developing area Qgk is detached from the developing sleeve 42 with the developer detachment pole S3 or pickoff magnetic pole and is restored to the developer storing chamber (2 to 4).

Figure 6A:
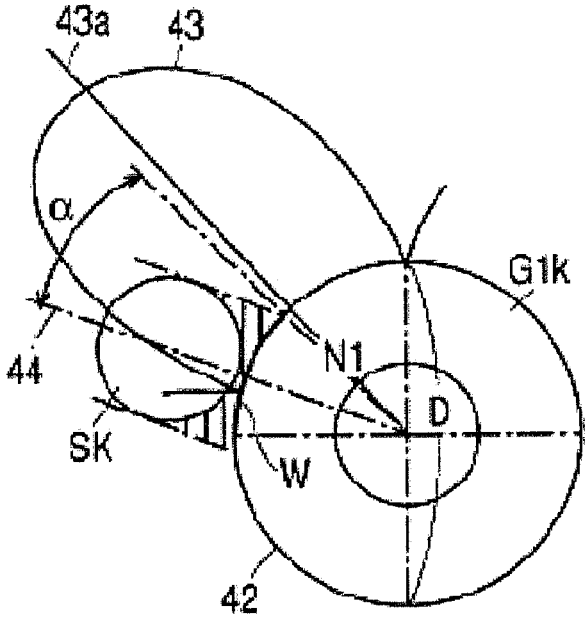
FIGS. 6A and 6B are schematic representations of the positional relationship between the peak position of a magnetic flux density distribution and the thickness regulation member.
Figure 6B:
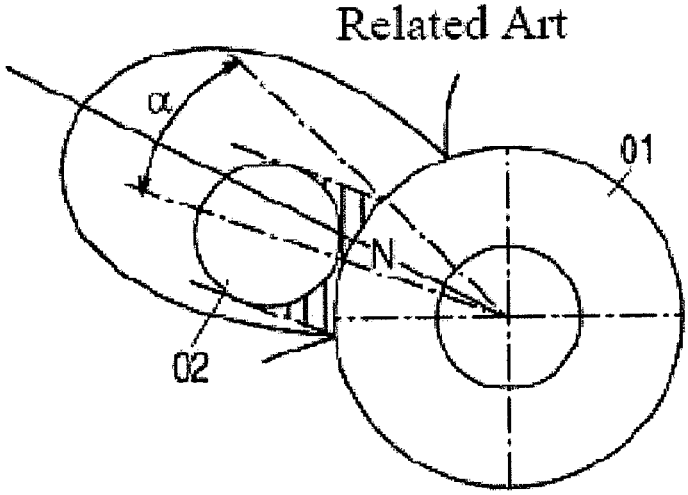

FIGS. 6A and 6B are schematic representations of the positional relationship between the peak position of a magnetic flux density distribution and the thickness regulation member; FIG. 6A is a schematic representation of the positional relationship in the first embodiment of the invention and FIG. 6B is a schematic representation of the positional relationship in a related art.

In FIGS. 3, 5, 6A and 6B, the thickness regulation member SK of the first embodiment is placed facing the developing sleeve 42 with a predetermined spacing between in a thickness regulation area Qsk and is formed of a cylindrical (round-bar) member made of a magnetic material.

In FIGS. 6A and 6B, in the developing device Gk of the first embodiment, letting the diameter of the developing sleeve 42 be D, the projection width when the thickness regulation member SK is projected onto the surface of the developing sleeve 42 be W, and angle $\alpha$ (degrees) be $180\times W/(D\times\pi)$, a maximum position 43*a* or a peak position 43*a* of a normal magnetic flux density distribution 43 of the thickness regulation pole N1 of the magnetic pole placed at the position nearest to the thickness regulation member SK downstream in the rotation direction of the developing sleeve 42 from the thickness regulation member SK is placed outside the area of the angle $\alpha$ downstream in the rotation direction of the developing sleeve 42 from the thickness regulation member SK. That is, in the first embodiment, the peak position 43*a* of the thickness regulation pole N1 is placed downstream in the rotation direction of the developing sleeve 42 and on the outside of the angle $\alpha$ with respect to a line segment 44 connecting the center of the thickness regulation member SK and the center of the developing roller G1*k*.

(Function of First Embodiment)

Figure 7A:
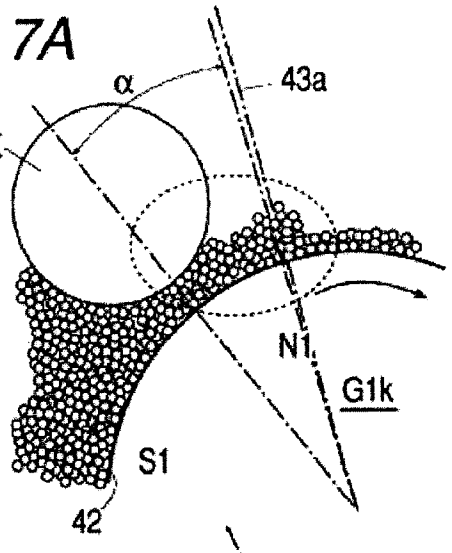
FIGS. 7A to 7D are function schematic representations of the first embodiment of the invention.
Figure 7B:
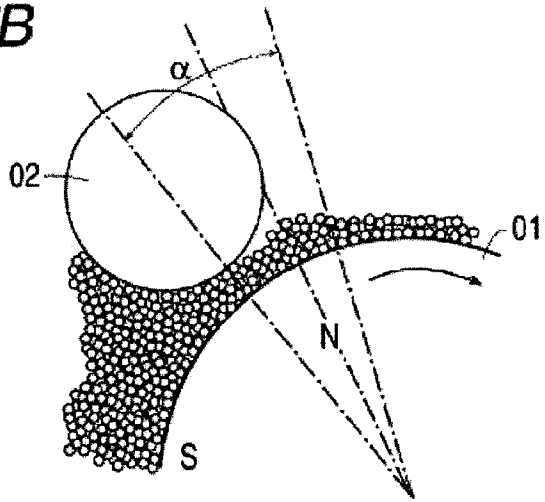
FIG. 7B Related Art
Figure 7C:
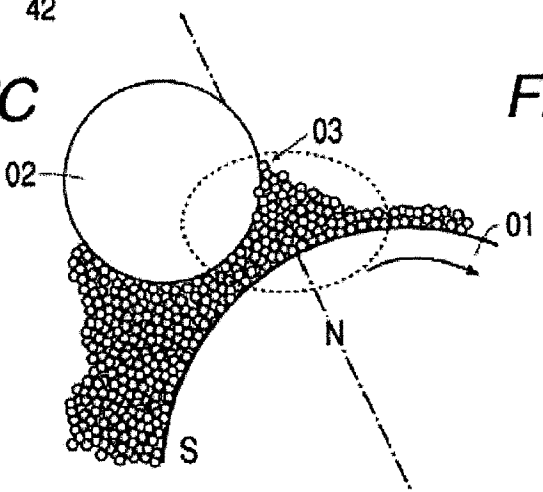
FIG. 7C Related Art
Figure 7D:
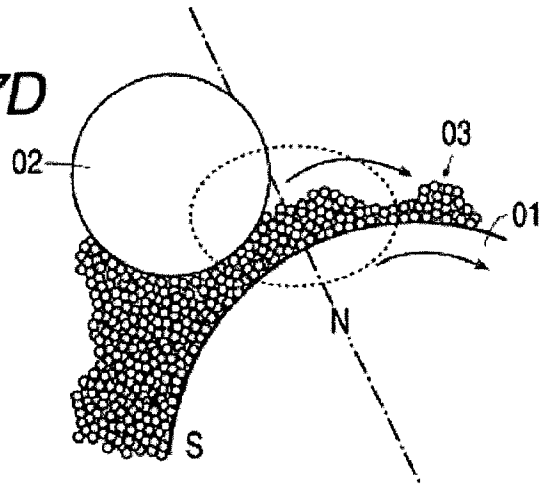
FIG. 7D Related Art

FIGS. 7A to 7D are schematic representations of the first embodiment of the invention; FIG. 7A is a function schematic representation of the relationship between the magnetic poles and the thickness regulation member and a developer in the first embodiment of the invention; FIG. 7B is a function schematic representation of the relationship between magnetic poles and a thickness regulation member and a developer in a related art in a state in which the downstream developer amount is small; FIG. 7C is a function schematic representation of the relationship between the magnetic poles and the thickness regulation member and a developer in the related art in a state in which the developer is much deposited downstream from the thickness regulation member; and FIG. 7D is a function schematic representation of the relationship between the magnetic poles and the thickness regulation member and a developer in the related art in a state in which the developer deposited downstream from the thickness regulation member crumbles and is transported downstream.

In the printer U as an example of the printer of the first embodiment including the components described above, the developer deposited on the surface of the developing sleeve 42 is regulated by the thickness regulation member SK which is formed like a round-bar shape made of a magnetic material, is miniaturized, and is reduced in cost, and the developer of a predetermined thickness based on the spacing the thickness regulation member SK and the developing sleeve 42 is transported to the developing area Qgk. At this time, a magnetic field occurs between the thickness regulation member SK made of a magnetic material in the first embodiment and the thickness regulation pole N1 and ears occur in a predetermined amount and the thickness is regulated effectively.

In FIGS. 6B and 7B to 7D, in a thickness regulation member 01 in the related art, ears are produced in the proximity of the thickness regulation member 01 and the thickness is regulated effectively and thus a developer 03 is deposited on the thickness regulation member 01 downstream in the rotation direction of a developing sleeve 02 from the thickness regulation member 01 as shown in FIG. 7C. The developer 03 crumbles at irregular intervals with rotation of the developing sleeve 02 and is transported downstream as shown in FIG. 7D and at the developing time, the density becomes nonuniform or density unevenness occurs, causing image quality degradation to occur.

In FIG. 7A, in the developing device Gy, Gm, Gc, Gk of the first embodiment, the largest ears occur at the maximum position 43*a* of the normal magnetic flux density distribution 43 of the thickness regulation pole N1, but deposition of the developer on the thickness regulation member SK is decreased as the thickness regulation pole N1 is placed outside the area of the angle α relative to the thickness regulation member SK. That is, occurrence of the situation in FIG. 7C, 7D is decreased.

First Experimental Example

Figure 8B:
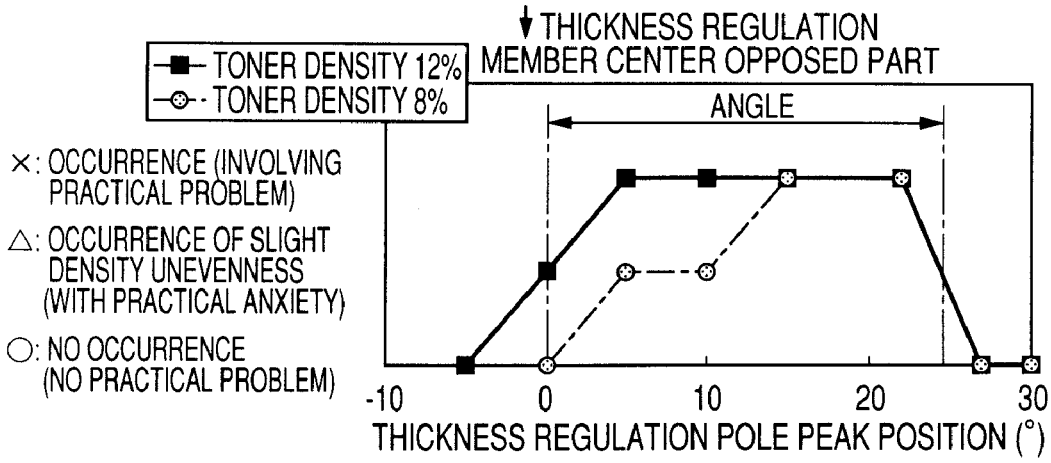
Figure 8C:
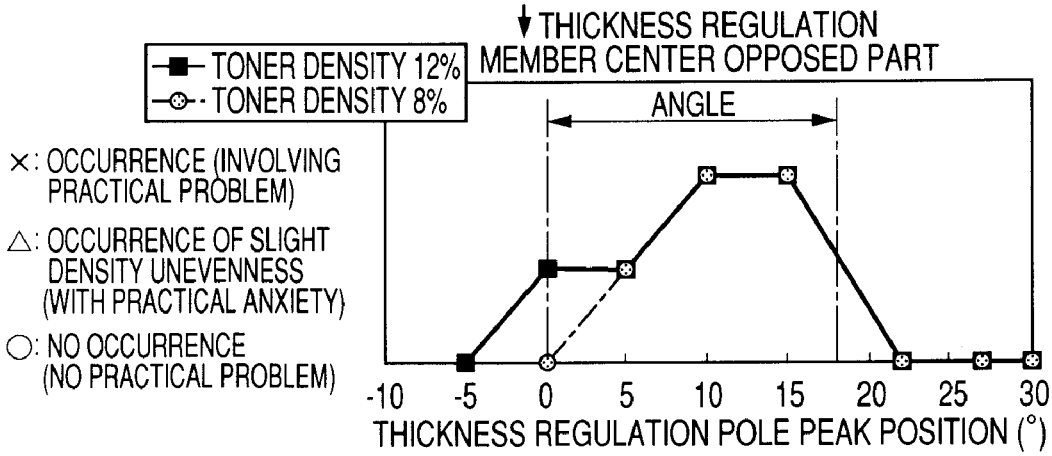

FIGS. 8A to 8C are schematic representations of a first experimental example of the first embodiment of the invention; FIG. 8A is a list of the experiment results; FIG. 8B is a graph of the experiment results with the peak positions of a thickness regulation pole taken on a horizontal axis and the results of density unevenness occurrence situation taken on a vertical axis about an experiment with sleeve outer diameter 12 mm; and FIG. 8C is a graph of the experiment results with the peak positions of a thickness regulation pole taken on a horizontal axis and the results of density unevenness occurrence situation taken on a vertical axis about an experiment with sleeve outer diameter 16 mm.

Next, the first experimental example was conducted to check the advantages of the configuration of the first embodiment. The first experimental example was conducted under the following conditions (1) to (4):

(1) A magnetic roller made of SUS 416 having a diameter of 5 mm was used as the thickness regulation member SK.

(2) Nonmagnetic toner having an average particle size of 6.5 μm and a magnetic carrier having an average particle size of 35 μm were used as a developer, and a resin-coated carrier having a specific gravity of 4.6 g/cm$^3$ with the surfaces of ferrite particles coated with resin was used as the magnetic carrier. The experiment was conducted at toner densities 4%, 8%, and 12%.

(3) As developing conditions, photoconductor charging potential (VH) was set to 300 V and a DC voltage of 200 V and an AC voltage of frequency 4 kHz at peak-to-peak voltage 1.1 kV were superposed and applied to the developing roller G1*k*.

(4) Two developing rollers are used as the developing roller and the experiment was conducted with the developing roller having the nonmagnetic developing sleeve 42 having an outer diameter of 12 mm and the magnet roll 41 having an outer diameter of about 10 mm and a center axis of 5 mm and the developing roller having the nonmagnetic developing sleeve 42 having an outer diameter of 16 mm and the magnet roll 41 having an outer diameter of about 13.8 mm and a center axis of 5 mm. The angles α in the developing rollers were 24.6 degrees and 18.2 degrees.

The experiment was conducted by setting the angle between the peak position 43*a* of the thickness regulation pole N1 and the center of the thickness regulation member SK shaped like a round rod to −5 degrees, 0 degrees, 5 degrees, 10 degrees, 15 degrees, 22 degrees, 27 degrees, and 30 degrees under the experiment conditions described above. The downstream side in the rotation direction of the developing sleeve was + and the upstream side was −.

Under the conditions, the occurrence state of density unevenness when a half-tone image was printed was evaluated as "□" when density unevenness did not occur with no practical problem, "◇" when slight density unevenness occurred with practical anxiety, and "X" when density unevenness involving a practical problem occurred.

The experiment results are shown in FIGS. 8A to 8C.

As shown in FIG. 8B, density unevenness did not occur regardless of low or high toner density when the peak position 43*a* of the thickness regulation pole N1 is 27 degrees or 30 degrees outside the area of α=24.6 degrees downstream.

As shown in FIG. 8C, density unevenness did not occur regardless of low or high toner density when the peak position 43*a* of the thickness regulation pole N1 is 22 degrees, 27 degrees, or degrees outside the area of α=18.2 degrees downstream.

Second Embodiment

Figure 9A:
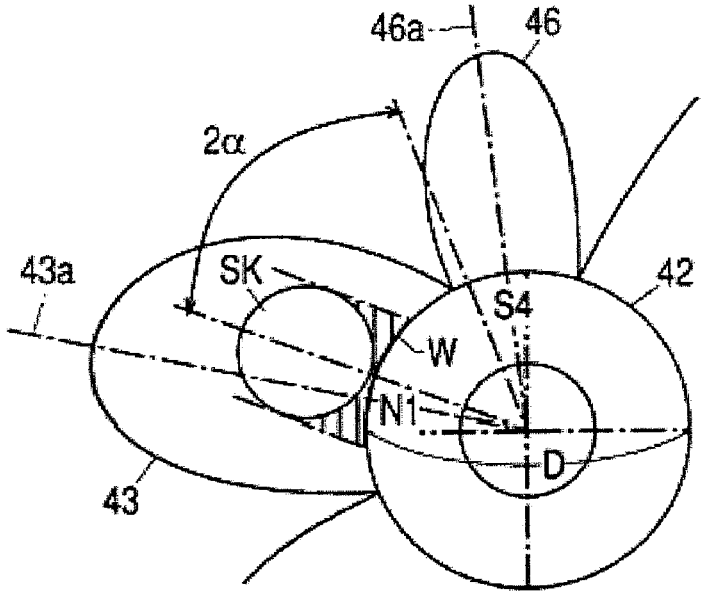
FIGS. 9A and 9B are schematic representations of the positional relationship between the peak position of a magnetic flux density distribution and a thickness regulation member in a second embodiment of the invention.
Figure 9B:
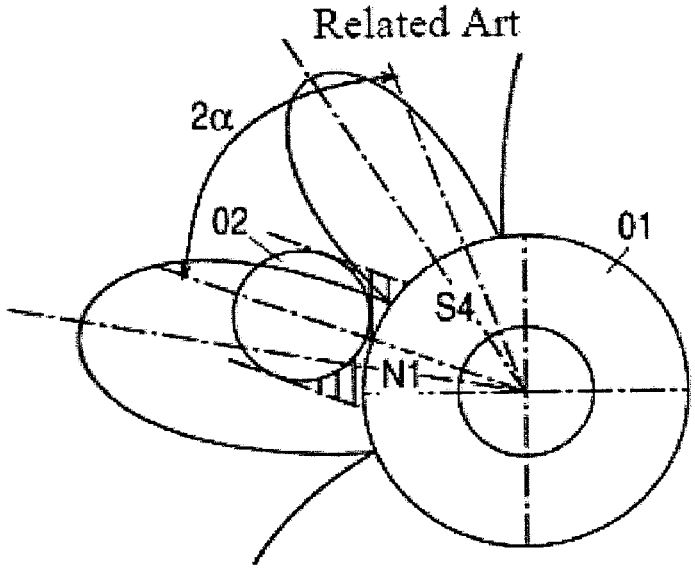

FIGS. 9A and 9B are schematic representations of the positional relationship between the peak position of a magnetic flux density distribution and a thickness regulation member in a second embodiment of the invention; FIG. 9A is a schematic representation of the positional relationship in the second embodiment of the invention corresponding to FIG. 6A in the first embodiment and FIG. 9B is a schematic representation of the positional relationship in a related art corresponding to FIG. 6B in the first embodiment.

Next, a printer of the second embodiment of the invention will be discussed. Components identical with or similar to those of the first embodiment are denoted by the same reference numerals in the accompanying drawings and will not be discussed in detail again. The second embodiment differs from the first embodiment only in the following:

In FIG. 9A, in developing devices Gy, Gm, Gc, and Gk of the second embodiment, a peak position 43*a* of a thickness regulation pole N1 as an example of an upstream magnetic pole is placed upstream in the rotation direction of a developing sleeve 42 from a thickness regulation member SK. An adjacent pole S4 as an example of a downstream magnetic pole is provided between the thickness regulation pole N1 and a developing pole S2, and a maximum position 46*a* or a peak position 46*a* of a normal magnetic flux density distribution 46 of the adjacent pole S4 is placed outside the area of an angle 2α downstream in the rotation direction of the developing sleeve 42 from the thickness regulation member SK.

(Function of Second Embodiment)

Figure 10A:
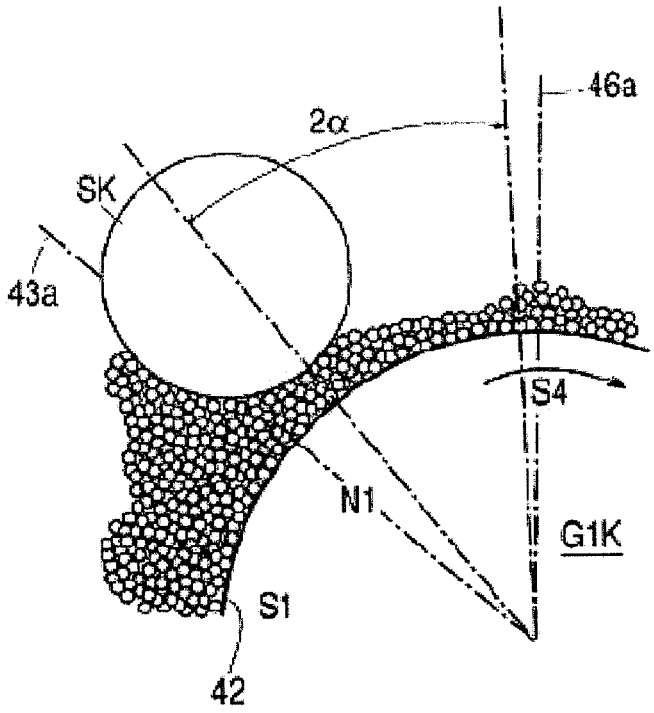
FIGS. 10A and 10B are function schematic representations of the second embodiment of the invention corresponding to FIGS. 7A to 7D in the first embodiment.
Figure 10B:
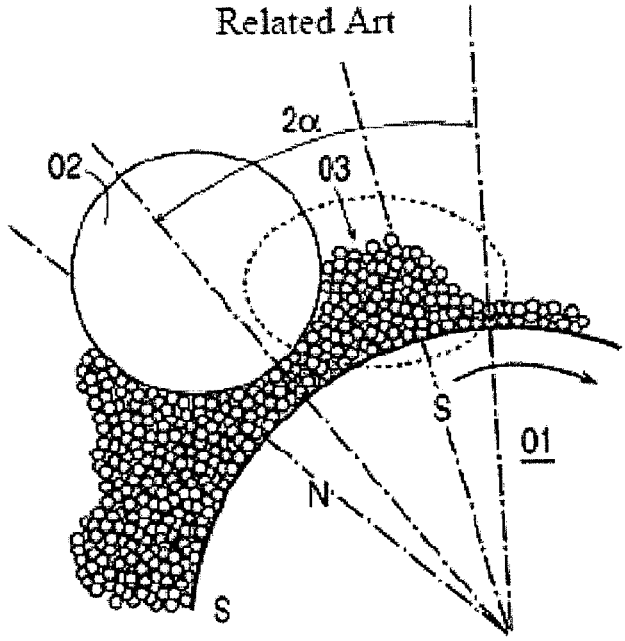
FIG. 10B Related Art

FIGS. 10A and 10B are schematic representations of the second embodiment of the invention corresponding to FIGS. 7A to 7D in the first embodiment; FIG. 10A is a function schematic representation of the relationship between the magnetic poles and the thickness regulation member and a developer in the second embodiment of the invention and FIG. 10B is a function schematic representation of the relationship between the magnetic poles and the thickness regulation member and a developer in the related art in a state in which the developer is much deposited downstream from the thickness regulation member.

In the printer U of the second embodiment including the components described above, ears occur with the upstream thickness regulation pole N1 and the thickness is regulated by the thickness regulation member SK as shown in FIG. 10A. Since the downstream adjacent pole S4 is placed outside the area of the angle 2α, ears of the developer are produced and the remaining developer is decreased downstream from the thickness regulation member SK made of a magnetic material as compared with the case where it is placed inside as in the related art, as shown in FIG. 10B. That is, the printer U of the second embodiment also has a similar function to that of the printer U of the first embodiment.

Second Experimental Example

FIGS. 11A and 11B are schematic representations of a second experimental example of the second embodiment of the invention; FIG. 11A is a list of the experiment results and FIG. 11B is a graph of the experiment results with the peak positions of an adjacent pole taken on a horizontal axis and the results of density unevenness occurrence situation taken on a vertical axis about the experiment results in FIG. 11A.

Next, the second experimental example was conducted to check the advantages of the configuration of the second embodiment. The second experimental example was conducted under the same experiment conditions (1) to (3) as in the first experimental example and the following experiment condition (4'):

(4') The experiment was conducted with a developing roller having the nonmagnetic developing sleeve 42 having an outer diameter of 12 mm and a magnet roll 41 having an outer diameter of about 10 mm and a center axis of 5 mm. The angle $\alpha$ at this time was 24.6 degrees.

Under the experiment conditions described above, the experiment was conducted by setting the angle between the peak position 46*a* of the adjacent pole S4 and the center of the thickness regulation member SK shaped like a round rod to 34.7 degrees, 41.3 degrees, and 47.0 degrees when the peak position 43*a* of the thickness regulation pole N1 and the center of the thickness regulation member SK shaped like a round rod was −15 degrees. The experiment was conducted by setting the angle between the peak position 46*a* of the adjacent pole S4 and the center of the thickness regulation member SK to 41.7 degrees, 48.3 degrees, and 54.0 degrees when the peak position 43*a* and the center of the thickness regulation member SK was −8 degrees. The experiment was conducted by setting the angle between the peak position 46*a* of the adjacent pole S4 and the center of the thickness regulation member SK to 44.7 degrees, 53.3 degrees, and 59.0 degrees when the peak position 43*a* and the center of the thickness regulation member SK was −3 degrees.

Under the conditions, the occurrence state of density unevenness when a half-tone image was printed was evaluated as "□" when density unevenness did not occur with no practical problem, "◇" when slight density unevenness occurred with practical anxiety, and "X" when density unevenness involving a practical problem occurred.

The experiment results are shown in FIGS. 11A and 11B.

As shown in FIG. 11B, although density unevenness does not occur in some cases in the area of $2\alpha$=49.2 degrees when the toner density is low, density unevenness did not occur regardless of low or high toner density at least when the peak position 46*a* of the adjacent pole S4 is 53.3 degrees, 54.0 degrees, or 59.0 degrees outside the area of $2\alpha$=49.2 degrees downstream.

Third Embodiment

Figure 12:
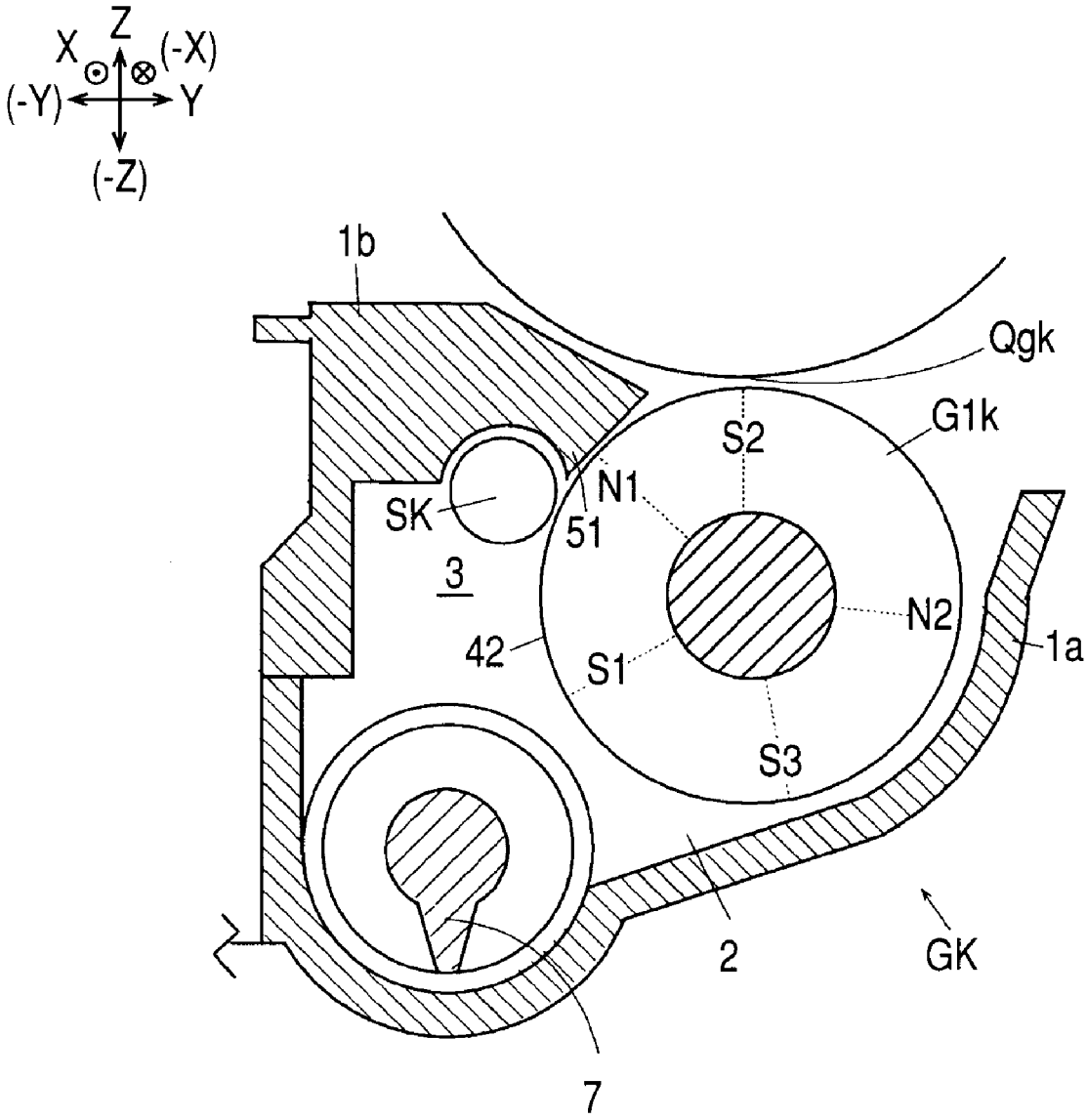
FIG. 12 is a schematic representation of a developing device of a third embodiment of the invention and is a drawing corresponding to FIG. 5 in the first embodiment.

FIG. 12 is a schematic representation of a developing device of a third embodiment of the invention and is a drawing corresponding to FIG. 5 in the first embodiment.

Next, an printer of the third embodiment of the invention will be discussed. Components identical with or similar to those of the first embodiment are denoted by the same reference numerals in the accompanying drawings and will not be discussed in detail again. The third embodiment differs from the first embodiment only in the following:

In FIG. 12, in developing devices Gy, Gm, Gc, and Gk of the third embodiment, a lid member 1*b* as an example of a wall member of a developer storage vessel 1 has a proximity member 51 brought close to a developing sleeve 42 within projection width W, namely, in the area of a downstream in the rotation direction of the developing sleeve 42 from a thickness regulation member SK.

(Function of Third Embodiment)

Figure 13:
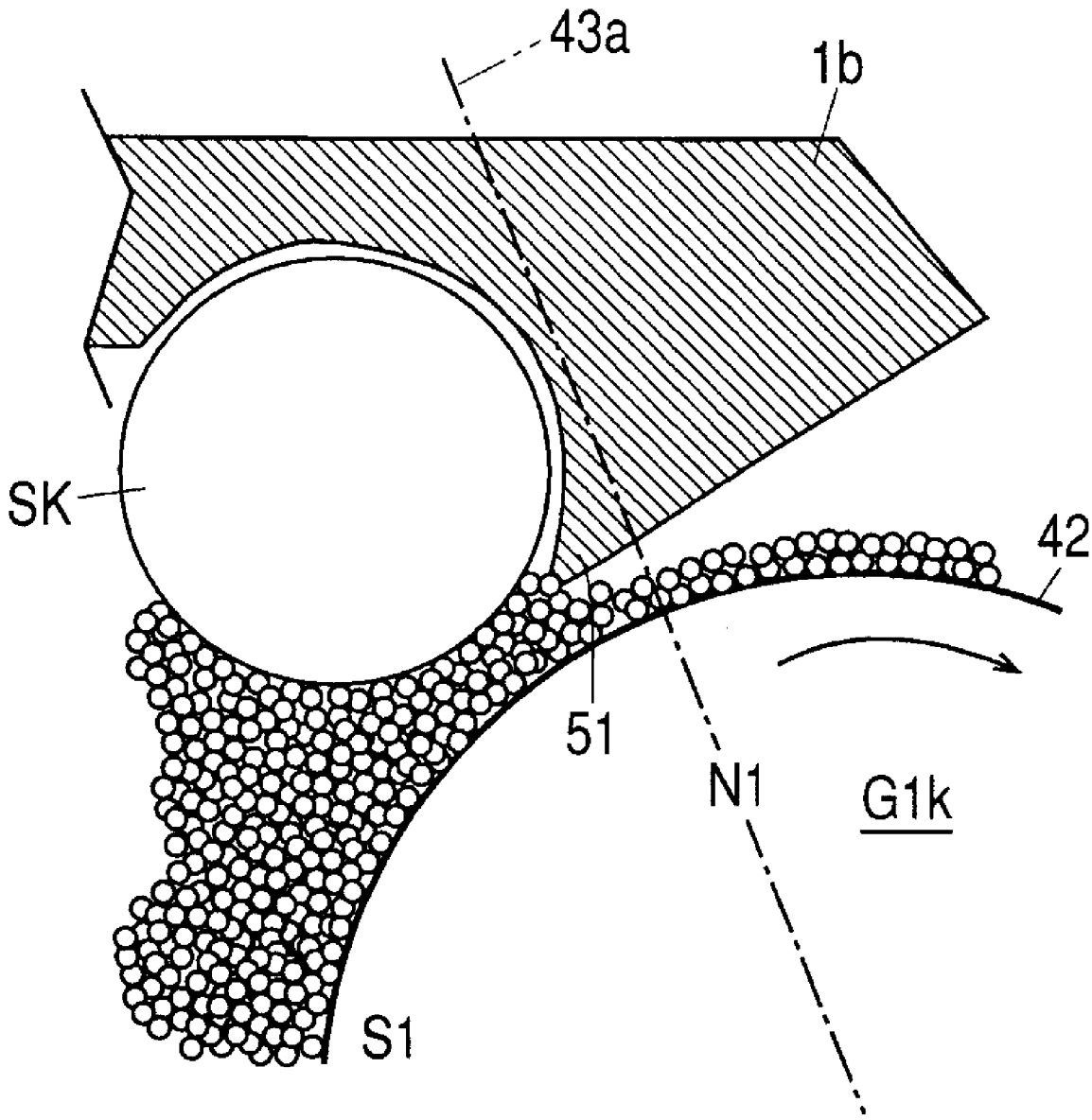
FIG. 13 is a function schematic representation of the third embodiment of the invention and is a drawing corresponding to FIG. 7A in the first embodiment.

FIG. 13 is a function schematic representation of the third embodiment of the invention and is a drawing corresponding to FIG. 7A in the first embodiment.

In FIG. 13, in the printer U of the third embodiment including the components described above, the thickness regulation member SK is covered with the proximity member 51 downstream from the thickness regulation member SK for preventing a developer from entering the space of the downstream surface of the thickness regulation member SK. That is, deposition of the developer on the downstream side of the thickness regulation member SK and remaining of the developer thereon because of a magnetic force is decreased, and the image formation apparatus U of the third embodiment also has a similar function to that of the image formation apparatus U of the first embodiment.

Fourth Embodiment

Figure 14A:
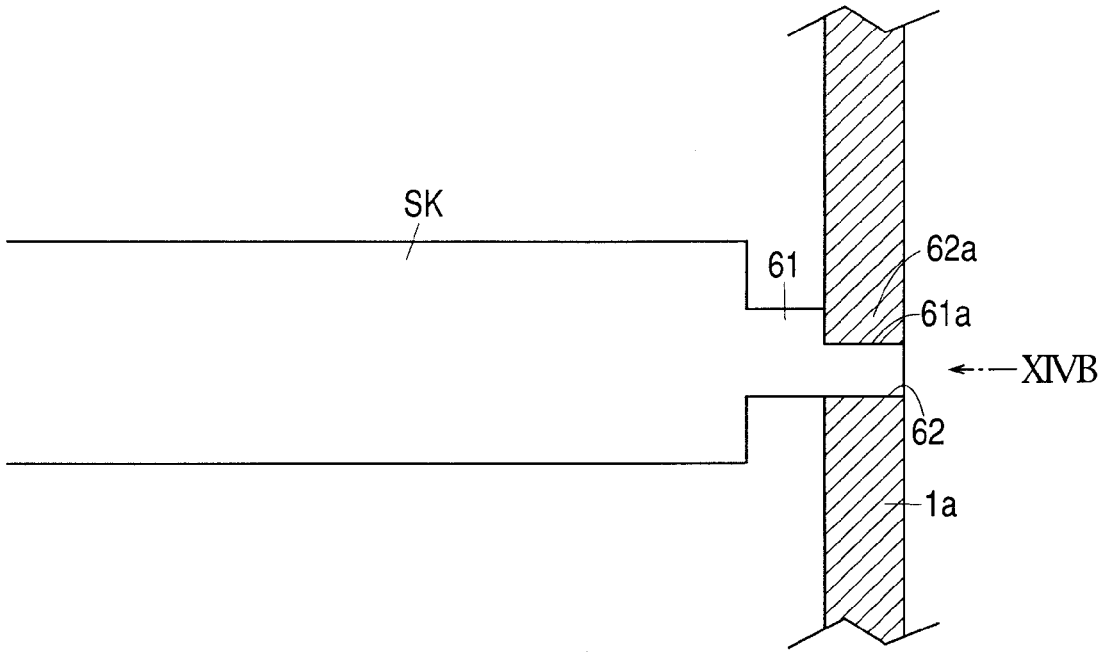
FIGS. 14A and 14B are schematic representations of a thickness regulation member of a fourth embodiment of the invention.
Figure 14B:
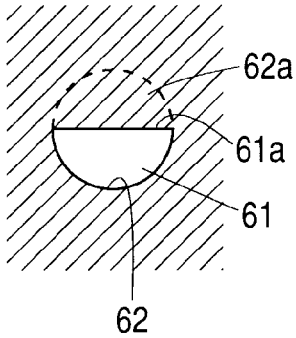

FIGS. 14A and 14B are schematic representations of a thickness regulation member of a fourth embodiment of the invention; FIG. 14A is a schematic representation of an end part of the thickness regulation member and FIG. 14B is a drawing of the end part seen from arrow XIVB direction in FIG. 14A.

Next, an image formation apparatus of the fourth embodiment of the invention will be discussed. Components identical with or similar to those of the first embodiment are denoted by the same reference numerals in the accompanying drawing and will not be discussed in detail again. The fourth embodiment differs from the first embodiment only in the following:

In FIG. 14, a supported shaft 61 as an example of a supported part is provided in an end part of a thickness regulation member SK of the fourth embodiment. The supported shaft 61 is formed at one end with a notch part 61*a* formed by D cut. A developing vessel main body 1*a* as an example of a wall member of a developing device Gy, Gm, Gc, Gk is formed with a support hole 62 as an example of a support part for supporting the supported shaft 61 of the thickness regulation member SK. The support hole 62 is formed with an unrotatable contact part 62*a* provided corresponding to the notch part 61*a* for coming in contact with the notch part 61*a* and supporting the thickness regulation member SK in an unrotatable state in a state in which the thickness regulation member SK is supported.

(Function of Fourth Embodiment)

Figure 15:
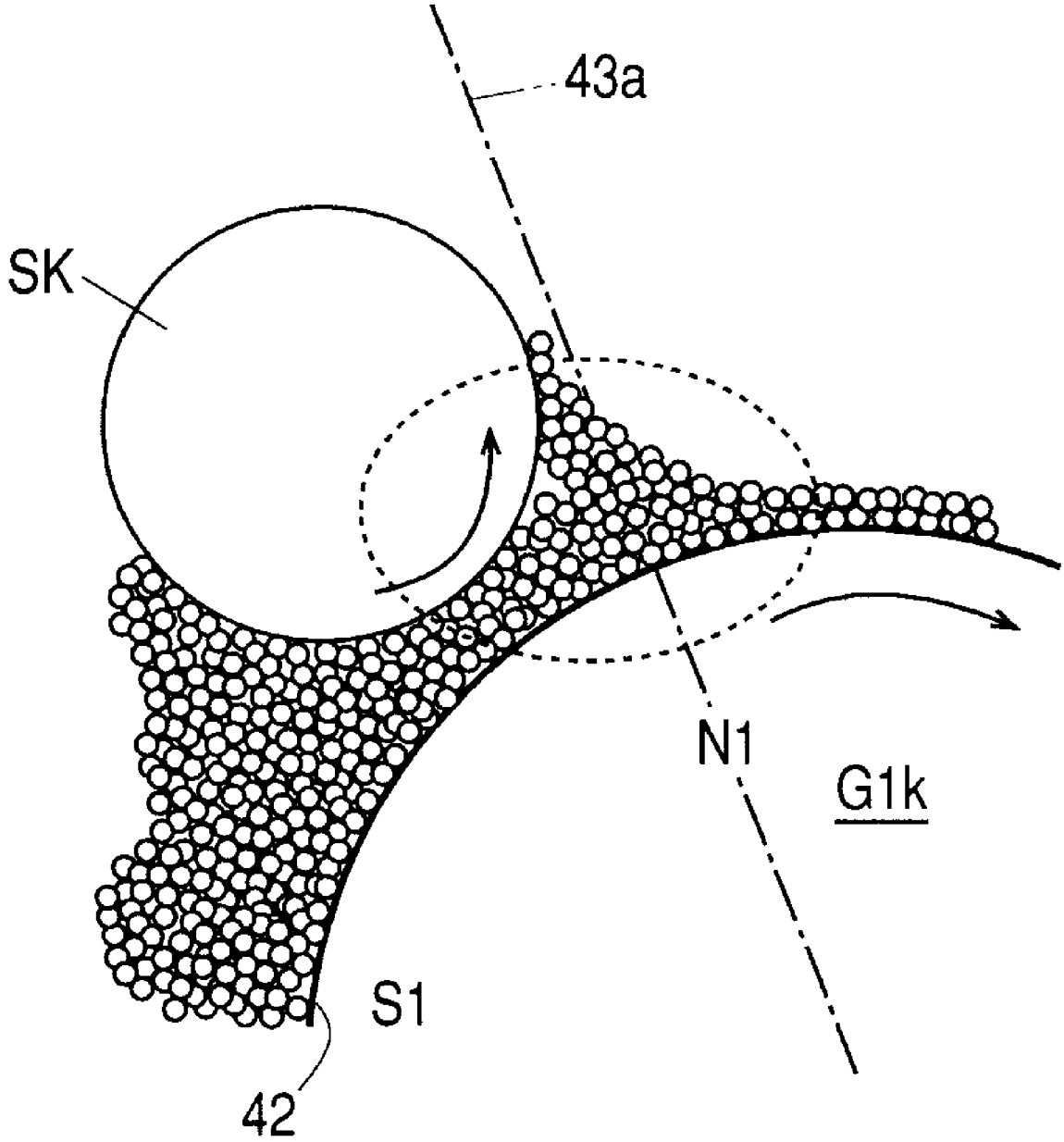
FIG. 15 is a function schematic representation of the fourth embodiment of the invention and is a function schematic representation if the thickness regulation member is supported for rotation.

FIG. 15 is a function schematic representation of the fourth embodiment of the invention and is a function schematic representation if the thickness regulation member is supported for rotation.

In the image formation apparatus U of the fourth embodiment including the components described above, the thickness regulation member SK is supported unrotatably. As shown in FIG. 15, if the thickness regulation member SK is supported for rotation, the thickness regulation member SK may rotate with rotation of a developing sleeve 42. If the thickness regulation member SK rotates, it is considered that the thickness regulation member SK will rotate with a developer deposited on the surface of the thickness regulation member SK and the developer will be deposited on the downstream side of the thickness regulation member SK. In contrast, the thickness regulation member SK is placed in an unrotatable state, whereby deposition of the developer on the downstream side of the thickness regulation member SK and remaining of the developer thereon is decreased, and the image formation apparatus U of the fourth embodiment also has a similar function to that of the image formation apparatus U of the first embodiment.

Modified Examples

While the embodiments of the invention have been described in detail, it is to be understood that the invention is not limited to the specific embodiments described above and various changes and modifications can be made without departing from the spirit and the scope of the invention as claimed. Modified examples (H01) to (H08) of the invention are illustrated below:

(H01) In the embodiments described above, a printer is illustrated as the image formation apparatus, but the image formation apparatus is not limited to the printer and can also be a facsimile machine, a copier, or a multifunctional processing machine including all or some of the functions. The image formation apparatus is not limited to an image formation apparatus of multicolor development and may be implemented as a single-color or monochrome image formation apparatus.

(H02) In the embodiments described above, the number of the magnetic poles of the developing roller G1*k*, the N pole, and the S pole can be changed as desired in response to the design, the specifications, and the like In addition, in the second embodiment, the adjacent pole S4 and the developing pole S1 can be made common.

(H03) In the embodiments described above, the configuration wherein the developing device and the developer replenishment vessel, 11, 16, or 18, are combined into one piece and can be replaced in one piece is illustrated, but the invention is not limited to it. The developing device and the developer replenishment vessel can also be provided as separate components and be joined by a developer transport member so as to transport a developer. That is, it is also possible to adopt a configuration including a developing unit and a toner cartridge.

(H04) In the embodiments described above, any can be used as the specific material names, the specific numeric values of the sizes, and the like, of the developing roller G1*k* and the thickness regulation member SK in response to the design, and the like (H05) In the embodiments described above, it is desirable that the thickness regulation member SK should be supported in an unrotatable state, but the thickness regulation member SK can also be supported for rotation.

(H06) In the embodiments described above, the configuration for supporting the thickness regulation member SK in an unrotatable state is not limited to the combination of the D cut and its corresponding hole illustrated in the fourth embodiment, and any configuration for supporting the thickness regulation member SK in an unrotatable state can be adopted.

(H07) In the embodiments described above, the developer transport member is implemented as the developer transport member having a rotation shaft and a helical transport vane or an auger, but is not limited to it. A developer transport member of any shape such as a developer transport member shaped like a helical spring or a coil spring or a developer transport member with a half-moon-shaped transport vane supported slantingly on a rotation shaft can be used.

(H08) In the embodiments described above, as a developer, a dual-component developer containing toner and a carrier is stored in the initial developer storage vessel and only toner is stored in the developer replenishment vessel, 11, 16 or 18, but the invention is not limited to the mode. It is also possible to eject the degraded developer little by little from the developing device and replenish the developing device with a high-density developer containing toner and a carrier having a higher density than the toner density in the developing device.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developing device comprising:

a developer supporter that includes:

a magnet member that has a plurality of magnetic poles; and a cylinder member that is placed on the outer periphery of the magnet member, and that rotates pre se, the developer supporter supporting a developer on a surface of the cylinder member; and a thickness regulation member that has a cylindrical shape, that is made of a magnetic material, that is placed facing the surface of the cylinder member with a predetermined spacing, and that regulates the thickness of the developer deposited on the surface of the cylinder member, wherein, of the plurality of the magnetic poles, a magnetic pole, which is placed at a position nearest to the thickness regulation member downstream in a rotation direction of the cylinder member from the thickness regulation member, has a maximum position of a normal magnetic flux density distribution, and the maximum position of the normal magnetic flux density distribution is placed outside the area of angle $\alpha$ downstream in the rotation direction of the cylinder member from the thickness regulation member, and wherein the diameter of the cylinder member is D, the projection width is W in a case where the thickness regulation member is projected onto the surface of the cylinder member, and the angle $\alpha$ is $180\times W/(D\times\pi)$.

2. The developing device as claimed in claim 1, wherein the maximum position of a normal magnetic flux density distribution of the upstream magnetic pole is placed upstream in the rotation direction of the cylinder member from the thickness regulation member, and the maximum position of the normal magnetic flux density distribution of the magnetic pole, which is placed downstream in the rotation direction of the cylinder member from the thickness regulation member, is placed outside the area of the angle $\alpha\times 2$ downstream in the rotation direction of the cylinder member from the thickness regulation member.

3. The developing device as claimed in claim 1, further comprising:

a wall member that is placed in the surrounding of the thickness regulation member, wherein a part of the wall member is brought close to the surface of the cylinder member within the projection width downstream in the rotation direction of the cylinder member from the thickness regulation member.

4. The developing device as claimed in claim 1, wherein the thickness regulation member is supported in an unrotatable state.

5. The developing device as claimed in claim 4, further comprising:

a notch part that is provided by cutting a part of an axial end part of the thickness regulation member; and an unrotatable contact part that is provided in the wall member of the developing device, that comes in contact with the notch part, and that prevents the thickness regulation member from rotating.

6. An image supporter unit comprising:

an image supporter; and a developing device as claimed in claim 1 that develops a latent image on a surface of the image supporter into a visible image.

7. An image formation apparatus comprising:

an image supporter;

a developing device as claimed in claim 1 that develops a latent image on a surface of the image supporter into a visible image;

a transfer device that transfers the visible image provided by the developing device to a medium; and a fixing device that fixes the visible image transferred to the medium.

* * * * *